US009437380B2

(12) United States Patent
Yamazaki et al.

(10) Patent No.: US 9,437,380 B2
(45) Date of Patent: Sep. 6, 2016

(54) SWITCHING UNIT OR SWITCHING GEAR

(71) Applicant: Hitachi, Ltd., Chiyoda-ku, Tokyo (JP)

(72) Inventors: Miki Yamazaki, Tokyo (JP); Tomoaki Utsumi, Tokyo (JP); Masato Yabu, Tokyo (JP); Ayumu Morita, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 14/404,081

(22) PCT Filed: Apr. 8, 2013

(86) PCT No.: PCT/JP2013/060580
§ 371 (c)(1),
(2) Date: Nov. 26, 2014

(87) PCT Pub. No.: WO2013/179772
PCT Pub. Date: Dec. 5, 2013

(65) Prior Publication Data

US 2015/0102013 A1 Apr. 16, 2015

(30) Foreign Application Priority Data

May 29, 2012 (JP) ..... 2012-121480

(51) Int. Cl.
*H01H 9/52* (2006.01)
*H01H 33/662* (2006.01)
(Continued)

(52) U.S. Cl.
CPC ... *H01H 33/66207* (2013.01); *H01H 33/6606* (2013.01); *H01H 33/6661* (2013.01); *H01H 2033/6613* (2013.01); *H01H 2033/6623* (2013.01)

(58) Field of Classification Search
CPC ..... H01H 2033/6613; H01H 2033/6623; H01H 9/52
See application file for complete search history.

(56) References Cited

U.S. PATENT DOCUMENTS 3,716,098 A * 2/1973 Dotto ..... F02P 7/061 165/80.3
4,123,618 A * 10/1978 Cushing ..... H01B 17/26 165/104.21

(Continued)

FOREIGN PATENT DOCUMENTS

| | | |
|---|---|---|
| JP | 59-4141 U | 1/1984 |
| JP | 60-54126 A | 3/1985 |
| JP | 2-128335 U | 10/1990 |
| JP | 5-303929 A | 11/1993 |

(Continued)

OTHER PUBLICATIONS

International Search Report (PCT/ISA/210) dated Jun. 4, 2013 with English-language translation (Four (4) pages).

(Continued)

*Primary Examiner* — Truc Nguyen
(74) *Attorney, Agent, or Firm* — Crowell & Moring LLP

(57) ABSTRACT

An object is to provide a switching unit or switching gear which enhances heat radiation performance and eliminates the need for an increase in unit size. In order to solve this problem the switching unit includes a switch and insulating resin located in a way to cover the periphery of the switch, in which the switch includes a fixed electrode, a movable electrode facing the fixed electrode and moving in an axial direction to contact or leave the fixed electrode, a bus side conductor connected to one of the electrodes and connected to a bus, and a load side conductor connected to the other electrode and connected to the load. The insulating resin has fins formed in a circumferential direction on the outer surface of the insulating resin and the distance between the periphery of the switch and the bottoms of the fins is almost constant in the circumferential direction.

22 Claims, 5 Drawing Sheets

(51) Int. Cl.
*H01H 33/66* (2006.01)
*H01H 33/666* (2006.01)

(56) References Cited

U.S. PATENT DOCUMENTS

| | | | | |
|---|---|---|---|---|
| 4,540,863 | A | 9/1985 | Bettge et al. | |
| 6,735,068 | B1 * | 5/2004 | Hartman | H01C 7/126 361/117 |
| 6,897,396 | B2 * | 5/2005 | Ito | H02B 13/0354 218/120 |
| 2001/0002666 | A1 * | 6/2001 | Ito | H02B 1/56 218/134 |

FOREIGN PATENT DOCUMENTS

| | | | |
|---|---|---|---|
| JP | 8-132711 | A | 5/1996 |
| JP | 2001-6502 | A | 1/2001 |
| JP | 2001-28858 | A | 1/2001 |
| JP | 2001-160342 | A | 6/2001 |
| JP | 2005-74885 | A | 3/2005 |
| JP | 2012-69345 | A | 4/2012 |

OTHER PUBLICATIONS

Korean Office Action issued in counterpart Korean Application No. 10-2014-7033134 dated Apr. 21, 2016 with English-language translation (eleven (11) pages).

* cited by examiner

SWITCHING UNIT OR SWITCHING GEAR

TECHNICAL FIELD

The present invention relates to switching units or switching gear and more particularly to cooling of a switching unit or switching gear which is solid-insulated with insulating resin.

BACKGROUND ART

Switching gear is installed as a power reception/distribution device in a power system to receive generated power from a power plant and distribute it to a load. A switching unit is installed in switching gear and is a key part of the switching gear which houses a switch.

Recently, in urban areas there has been a problem that power consumption concentrates in certain regions and construction of distributing substations in response to the growing demand for power consumption is difficult and there is shortage of space for installation of power distributing pipes. In addition, the demand for higher operating rates of supply facilities is growing. In order to respond to the demand, studies have been conducted on the construction of efficient power supply facilities which encourage a high voltage system to absorb loads by boosting the distribution voltage, namely increasing the capacity per line. To this end, distributing implements and substation equipment for the high voltage system must be more compact.

Also, since the inside of the switching gear is hot mainly in the current conduction area when a large current flows, the cooling performance must be improved for a large current to flow. An example of switching gear with a function to improve the cooling performance as mentioned above is described in Patent Literature 1. Patent Literature 1 describes that cooling performance is improved by providing resin or metal fins on the resin layer covering the switching gear.

CITATION LIST

Patent Literature

Patent Literature 1: Japanese Patent Application Laid-Open No. 2001-160342

SUMMARY OF INVENTION

Technical Problem

However, according to Patent Literature 1, the connected fin bottoms form a rectangle in a plan view, but the vacuum valve formed inside the resin layer is cylindrical and the positions of the fin bottoms and the inner shape of the resin layer are not correlated. If the fins are made of resin, since resin is lower in thermal conductivity than metal and a temperature distribution occurs, simply using fins to a large extent is hardly expected to improve the heat radiation effect dramatically. On the other hand, since switching gear is installed in a confined space, an increase in its size is undesirable.

Therefore, the present invention has an object to provide a switching unit or switching gear which enhances heat radiation performance and eliminates the need for an increase in the size.

Solution to Problem

In order to solve the above problem, the switching unit according to the present invention includes: a switch which includes a fixed electrode, a movable electrode facing the fixed electrode and moving in the axial direction to contact or leave the fixed electrode, a bus side conductor connected to one of the electrodes and connected to a bus, and a load side conductor connected to the other electrode and connected to a load; and insulating resin located in a way to cover the periphery of the switch, in which the insulating resin has fins formed in a circumferential direction on an outer surface of the insulating resin and the distance between the periphery of the switch and the bottoms of the fins is almost constant in the circumferential direction.

Advantageous Effects of Invention

According to the present invention, it is possible to provide a switching unit or switching gear which enhances heat radiation performance and eliminates the need for an increase in the size.

DESCRIPTION OF EMBODIMENTS

Next, the preferred embodiments of the present invention will be described. The embodiments described below are just examples and obviously the invention is not limited to the embodiments described below.

First Embodiment

Next, the first embodiment will be described referring to FIGS. 1 and 2.

Figure 1:
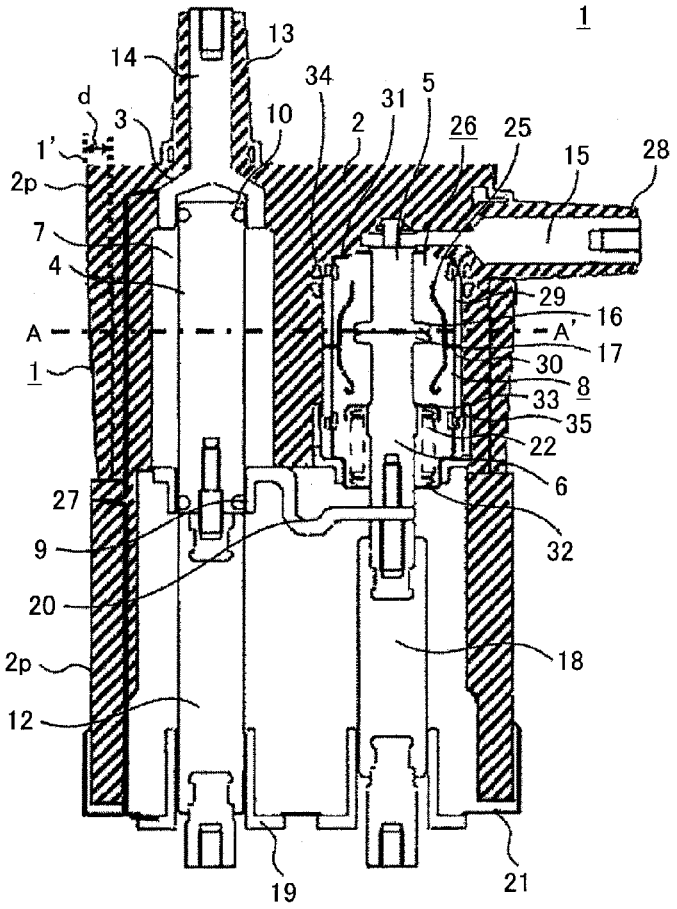
FIG. 1 is a side sectional view of a switching unit according to a first embodiment.

As shown in FIG. 1, the switching unit according to this embodiment mainly includes a grounded metal case 21, insulating resin 2 of epoxy, etc. connected to the metal case 21, a vacuum valve 26 and a grounding disconnection part 27 which are integrally cast with the insulating resin 2, a bushing 13 for a bus, and a bushing 28 for a cable.

The vacuum valve 26 has, in a vacuum container 8 constituted by connecting a fixed side ceramics insulating cylinder 29, movable side ceramics insulating cylinder 30, fixed side end plate 31 and movable side end plate 32: a fixed side electrode 16; a movable side electrode 17; a fixed side conductor 5 connected to the fixed side electrode 16; a movable side conductor 6 connected to the movable side electrode 16, a movable side conductor 6 connected to the movable side electrode 17; and an arc shield 25 for protecting the ceramic insulating cylinders 29 and 30 from arcs during electrode opening/closing operation. The fixed side conductor 5 is connected to a cable bushing center conductor 15 to supply power to the load. The cable bushing center conductor 15 is located perpendicularly to the fixed side conductor 5 and conductors concentrate in the area between the cable bushing center conductor 15 and fixed side conductor 5, so the temperature easily rises in the area during use. Thus, in the area around an intersection where a plurality of conductors gather, heat generation density increases and heat accumulates during use. In addition, a bellows 22 is located on the movable side to enable movement of the movable side conductor 6 while keeping the vacuum condition inside the vacuum valve 26. The vacuum valve 26 keeps the vacuum inside it through the bellows 22 connected to the movable side end plate 32 and movable side conductor 6 and enables the movable side electrode 17 and movable side conductor 6 to move in the axial direction to perform switching between the On and Off states. A bellows shield 33 is located near the joint between the bellows 22 and movable side conductor 6 to protect the bellows 22 from arcs, etc. during switching operation and also can alleviate concentration of electric fields at the ends of the bellows 22. The movable side conductor 6 is connected to an aerial-insulated and solid-insulated actuating rod 18 for the vacuum valve 26, and the vacuum valve actuating rod 18 is connected to an actuator (not shown). A fixed side field alleviating shield 34 is located around the fixed side ceramics insulating cylinder 29 to alleviate concentration of electric fields at the joint with the fixed side end plate 31 and a movable side field alleviating shield 35 is located around the movable side ceramics insulating cylinder 30 to alleviate concentration of electric fields at the joint with the movable side end plate 32.

The grounding disconnection part 27, connected to a bus bushing center conductor 14, includes a bushing fixed electrode 3 connected to the bus through this center conductor, a grounding side fixed electrode (guide) 19 as ground potential, and a middle fixed electrode located at the axial midpoint between them and electrically connected to the movable side conductor 6 on the vacuum valve 26 side through a flexible conductor 20, and its inside is aerially insulated. These fixed electrodes have the same inside diameter and are arranged in line. When a grounding disconnection part movable conductor 4 linearly moves in the grounding disconnection part 27 with respect to these fixed electrodes, switching to three switching positions, namely positions for making the circuit, breaking the circuit, and grounding, can be made. The grounding disconnection part movable conductor 4 is coupled to an aerial-insulated and solid-insulated actuating rod 12 and can move through an operating mechanism (not shown). Since the portion of the grounding disconnection part movable conductor 4 which is to contact the above fixed contacts is a spring contact 10, it can contact them reliably without hindering movement of the grounding disconnection part movable conductor 4, due to its elastic force.

The bus bushing 13 is formed by covering the periphery of the bus bushing center conductor 14 with the insulating resin 2 and the cable bushing 28 is formed by covering the periphery of the cable bushing center conductor 15 with the insulating resin 2.

As material for the actuating rod 12 for the vacuum valve, the actuating rod 18 for the grounding disconnection part and the insulating resin 2, epoxy resin is used in consideration of insulation properties and mechanical strength and because of high formability. Also, the actuating rods 12 and 18 and the insulating resin 2 are solid-insulated by themselves and aerial-insulated by the ambient gas.

The grounding disconnection part movable conductor 4, fixed side conductor 5, movable side conductor 6, air area 7 and vacuum container 8 are integrally cast with the insulating resin 2 and resin radiating fins 1 of the same material as the insulating resin 2 are provided on the outer surface of the insulating resin 2 covering the grounding disconnection part movable conductor 4, fixed side conductor 5, and movable side conductor 6. As shown in FIG. 1, the outer surface nearest to the heat source is designed to be the largest height (spot) 1' of the resin radiating fins and as the distance from the heat source increases, height 1*d* of the resin radiating fins 1 gradually (continuously) decreases. Here, the heat source corresponds to an area where conductors concentrate (because the density of conductors as resistances is high) or an area where electrodes contact each other (because contact resistance is generated). In addition, covering by the insulating resin 2 results in higher air tightness and lower heat radiation performance, thereby accelerating accumulation of heat. On the other hand, if, even around the heat source, gas surrounds the heat source, heat radiation performance increases and the area is unlikely to be a heat accumulation spot even though it is a spot where heat generation easily occurs. For this reason, the resin radiating fins between the cable bushing center conductor 15 and vacuum valve 26, which correspond to an area where conductors concentrate and whose periphery is covered by the insulating resin 2, are large in fin height and as the distance from that area increases, the fins are smaller in fin height. Also, the fins around the spring contact 10 and the bushing fixed electrode 3 which correspond to an area where electrodes contact each other and an area whose periphery is covered by the insulating resin 2 are large in fin height and in remoter areas from that area, the fin height is smaller. In this specification, an area which is a heat source and covered by the insulating resin 2 is called a heat accumulation spot. The peripheries of the bus bushing 13 and cable bushing 28 and the middle fixed electrode 9 coupled to the flexible conductor 20 with high heat resistance are heat accumulation spots. A flat part (flat surface) 2*p* with a height equal to or larger than the area of resin radiating fins 1 with the largest height is located opposite (actuator side) to the side where the resin radiating fins 1 are located.

Figure 2:
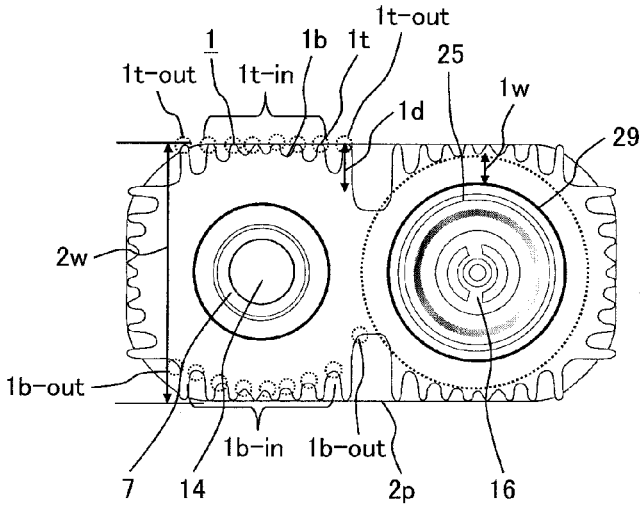
FIG. 2 is a sectional view of the switching unit according to the first embodiment, taken along the line A-A'.

Furthermore, in this embodiment, as shown in FIG. 2 (sectional view taken along the line A-A' of FIG. 1), the shape of the resin radiating fins in the circumferential direction of the vacuum container 8 and grounding disconnection part 27 is such that the height of the resin radiating fins gradually changes in the circumferential direction. The bottoms 1*b* of the resin radiating fins are formed so that the resin distance 1W between the bottoms 1*b* of the resin radiating fins and the periphery of the vacuum container 8 is kept constant circumferentially. While this ensures the required minimum resin height for strength and insulation performance, heat radiation performance can be enhanced. In addition, the tips 1*t* and bottoms 1*b* of the resin radiating fins 1 have the required minimum curvatures to ensure strength and insulation performance according to height 1*d* of the resin radiating fins 1. Concretely, when height 1*d* is larger, the curvature is larger and the inner (bottom) curvature 1*b*-out of a fin with the largest height in the fin radial direction is made larger than the fin inner curvatures 1*b*-in other than the inner (bottom) curvature 1*b*-out of the fin with the largest height in the fin radial direction. Furthermore, a flat part (flat surface) 2*p* where no resin radiating fins 1 exist is formed in part of the resin layer outermost surface and the tip 1*t* of a resin radiating fin 1 with any height is located inside the resin layer flat part 2*p* surface (including a case that the tip of a resin radiating fin is on the surface. The tips of the resin radiating fins should not protrude from the surface). Here, the resin layer flat part 2*p* surface includes a portion where the flat part does not exist. Consequently, when the resin-molded switching unit is placed (laid down) during assembling work, etc., the flat part 2*p* can receive the weight of the switching unit so that the resin radiating fin tips are not damaged.

Next, how the switching unit according to this embodiment is used will be described. When the switching unit is connected to the power system, power is supplied into the switching unit from the bus and if the grounding disconnection part 27 is in the closed position and the vacuum switch is turned on, power is supplied from the power system through the bus to the load in the following order: the bus bushing center conductor 14 to the bushing fixed electrode 3 to the spring contact 10 to the grounding disconnection part movable conductor 4 to the spring contact 10 to the middle fixed electrode 9 to the flexible conductor 20 to the movable side conductor 6 to the movable side electrode 17 to the fixed side electrode 16 to the fixed side conductor 5 to the cable bushing center conductor 15 via the cable. In this case, the above current conduction areas generate Joule heat depending on the resistance value. When high voltage is applied as in switching gear, the amount of generated heat is very large and consideration of heat radiation performance is indispensable in the manufacture of a device.

The Joule heat generated at various parts with the power on is large at the area of contact between the bushing fixed electrode 3 and the grounding disconnection part movable conductor 4 through the spring contact 10 and at the area of contact between the movable side electrode 17 and the fixed side electrode 16; and also near these areas, particularly near the area where the fixed side conductor 5 and vacuum container end are fixed, there is an environment in which radiated heat easily accumulates locally. Also since the temperatures of the grounding disconnection part movable conductor 4, fixed side conductor 5 and movable side conductor 6 as conductors in the switch rise, emission of thermal electrons is accelerated with rise in the temperatures, resulting in deterioration in insulation performance. A possible approach to preventing temperature rise is to suppress heat generation and a concrete approach may be to increase the sizes of the grounding disconnection part movable conductor 4, fixed side conductor 5 and movable side conductor 6 to decrease the current density or increase the contact pressure on the electrodes 16 and 17 in the switching part to decrease the contact pressure. However, the former approach leads to a larger unit size and the latter leads to increased capacity per line because the operating mechanism needs a larger driving force. As a consequence, in either case, the unit may have to be larger.

Therefore, as a countermeasure against temperature rise, improvement of heat radiation performance is effective rather than decrease of resistance to reduce the amount of generated heat. For improvement of the heat radiation performance, considering that the Joule heat generated at various parts of the switch with the power on is mainly derived from heat generation at contacts between electrodes and at conductors, it is more effective to radiate the heat mainly near these heat-generating spots. However, when the switching unit is integrally cast with the insulating resin 2 like the switching unit according to this embodiment, if the whole outer surface of the insulating resin 2 is shaped to have cooling fins, cooling fins are provided on all the areas including an area where the temperature difference between the outer surface of the insulating resin 2 and the switching gear board housing the switching unit is small, namely an area which does not require improved heat radiation performance.

Particularly when insulating resin fins are provided, since resin is lower in thermal conductivity than metal, a temperature distribution will occur in the insulating resin fins and heat will not be transferred to a remoter area from the heat generating spot, so the presence of radiating fins in such area scarcely contributes to improvement in heat radiation performance. Since the presence of fins all over the outer surface leads to an increase in the weight of the switching unit, it is desirable to determine the shape of fins and their positions so as to contribute well to improvement in heat radiation performance, rather than to provide fins all over.

For this reason, in the switching unit according to this embodiment, the resin radiating fins between the cable bushing center conductor 15 and the vacuum valve 26 have a large height and remoter fins from that area have a smaller height. Also, the fins around the spring contact 10 and bushing fixed electrode 3 have a large height and remoter fins from that area have a smaller height.

Also since the Joule heat generated at various parts of the switch with the power on is mainly derived from heat generation at electrode contacts and conductors, it is more effective to radiate heat mainly near the heat generating spots. However, if fins are formed all over the outer surface of the integrally cast switch without correlation with the outer shape of the switch located inside the insulating resin, the same type of fins are present even in areas where the temperature difference between the resin outer surface and the board is small. When the fins are formed of insulating resin, a temperature distribution will occur in the fins because the thermal conductivity of resin is lower than that of metal. Therefore, when resin radiating fins are used, the presence of the resin radiating fins all over may lead to an increase in the weight of the switch, so it is useful to determine the fin shape and fin positions appropriately in consideration of the radiation efficiency of the fins. In other words, if the fin height and the interval between fins are fixed, it is difficult to perform effective cooling depending on the characteristics of resin.

In this embodiment, as for the shape of the resin radiating fins in the circumferential direction of the vacuum container 8 and grounding disconnection part 27, the height gradually changes in the circumferential direction in order to ensure strength and insulation performance. The bottoms 1*b* of the resin radiating fins are formed so that resin distance 1W between the resin radiating fin bottoms 1*b* and the outer periphery of the vacuum container 8 is kept constant (namely, when a single resin-covered switch is used, the pattern made by connecting the bottoms of the resin radiating fins is similar to the pattern of the outer periphery of the switch. If there are a plurality of resin-covered switches, an area between switches deviates from similarity) so that the heat radiation performance can be improved while the required minimum resin height for strength and insulation performance is ensured. In addition, inner curvature 1*b*-out of the fin with the largest radial height among the resin radiating fins is made larger than inner curvature 1*b*-in of the fins other than the fin with the largest height. The reason is that because the resin radiating fin with the largest height deforms relatively largely and stress may concentrate on the tips 1*t* of the resin radiating fins 1 and the bottoms 1, its curvature is made the largest to reduce stress concentration. In addition, the resin radiating fin with the largest height is considered to cause electric fields to concentrate relatively easily. However, as mentioned above, when the inner curvature 1*b*-out of the resin radiating fin with the largest height is larger than the inner curvature 1*b*-in of the fins other than the fin with the largest height, concentration of electric fields can be alleviated. In other words, tolerance can be improved in terms of stress and field strength by adoption of the above structure. A flat part 2*p* where no resin radiating fins 1 exist is formed on part of the resin layer outermost surface so that the resin layer flat part 2*p* is made nearer to the resin layer outer surface than the tips 1*t* of the resin radiating fins 1. This protects the resin radiating fins through contact of the resin layer outer surface during assembling work, etc.

As mentioned above, Joule heat is generated in current conduction areas while current flows. The generated Joule heat is transferred to the surrounding medium and released outside from the surrounding medium. Here, the heat generated by both the cable bushing center conductor 15 and the conductors in the vacuum valve 26 is transferred to the insulating resin 2 between the cable bushing center conductor 15 and the vacuum valve 26, so higher radiation performance is required there. In this embodiment, the resin radiating fins between the cable bushing center conductor 15 and the vacuum valve 26 have a larger fin height and remoter fins from this area have a smaller fin height. In the area, a heat accumulation spot, the fins have a larger height to improve heat radiation performance. On the other hand, as the distance from the area as a heat accumulation spot increases, the density of conductors decreases and such remoter areas are no longer near a heat generating spot and also because the thermal conductivity of insulating resin fins is low, heat is hardly transferred from a heat accumulation spot; from both the above viewpoints, the need for improvement in heat radiation performance becomes smaller. Therefore, in order to avoid an increase in the size, in remoter areas from a heat accumulation spot, the resin radiating fins 1 are made to have a smaller height.

Similarly the insulating resin 2 around the spring contact 10 and bushing fixed electrode 3 covers the bushing fixed electrode 3, grounding disconnection part movable conductor 4, and the contact area between the spring contact 10 and bushing fixed electrode 3 and constitutes a heat accumulation spot. For this reason, the resin radiating fins 1 in this area are made to have a larger fin height and remoter fins from the area are made to have a smaller height.

The above not only improves cooling performance but also eliminates the possibility that the unit is larger than necessary.

Basically the resin radiating fins 1 are intended to expand the surface of heat transfer to the surroundings to reduce the surface heat density, so the larger the heat transfer area is, the better the performance is. However, expansion of the surface area more than necessary might cause a decline in surface thermal conductivity and a decline in the efficiency of heat transfer to the tips of the resin radiating fins 1. In other words, it is when the whole heat radiating surface has the same temperature as the heat source that the resin radiating fins 1 are most effective. Thus, in the case of metal, the thermal conductivity is high and a temperature distribution hardly occurs; on the other hand, in the case of the insulating resin 2, the thermal conductivity is low and a temperature distribution occurs to a large extent, so the resin radiating fins 1 are not made uniform in height but their height is gradually changed (height is changed in the fin longitudinal or axial direction and the circumferential direction) so that the resin radiating fins 1 perform cooling effectively.

In the switching unit according to this embodiment, the height of the resin radiating fins 1 gradually changes in the fin longitudinal direction (movable electrode axial direction) to deliver higher cooling performance than when the height does not change. In addition, the bottoms 1*b* of the resin radiating fins are shaped so that the resin distance 1W between the resin radiating fin bottoms 1*b* and the periphery of the vacuum container 8 is kept constant in order to ensure the required minimum resin height for strength and insulation performance and enhance heat radiation performance. In addition, the tips 1*t* and bottoms 1*b* of the resin radiating fins 1 have the required minimum curvatures to ensure strength and insulation performance according to height 1*d* of the resin radiating fins 1 (when height 1*d* is larger, the curvature is larger) and a flat part 2*p* where no resin radiating fins 1 exist is formed in part of the resin layer outermost surface and the resin layer flat part 2*p* is made nearer to the resin layer surface than the tips 1*t* of the resin radiating fins 1 to protect the resin radiating fins through contact of the resin layer outer surface during assembling work, etc. and eliminates the possibility that the unit is larger than necessary.

The height is large in a heat accumulation spot and in remoter areas from the spot, the height is smaller, thereby permitting more appropriate cooling for a temperature condition which occurs with the power on.

The switching unit according to this embodiment is formed by integrally molding the breaker and the grounding switch with insulating resin 2 and compactness is achieved by improvement of insulation characteristics and optimization. In this compact switching unit, sealability is high and heat easily concentrates, so the need for improved heat radiation performance is considerable rather than the need for reduction of heat generation. In this embodiment, resin radiating fins 1 are provided on the insulating resin 2 of the above switching unit and the fin height gradually changes in the longitudinal and circumferential directions and the tips 1*t* and bottoms 1*b* of the resin radiating fins have the required minimum curvatures to ensure strength and insulation performance according to height 1*d*, so that the fins are more appropriate. In addition, this eliminates the need for an increase in the size of the unit and does not prevent the unit from being compact. Rather, as a switching unit with heat radiation performance, the unit is very compact.

Furthermore, in this embodiment, the grounding disconnection part serves as a grounding switch which has a circuit breaking function, and due to this point as well as the above points, more compactness is achieved. Furthermore, the adoption of both vacuum insulation and aerial insulation makes it possible to provide a switch which is not large even if an aerial grounding disconnection part is employed. In the case of a switching unit which adopts either or all of these means to achieve compactness in this way, usually the heat generation density would increase and the heat radiation space would decreases; on the other hand, since the resin radiating fins 1 according to this embodiment improve heat radiation performance, desirably they eliminate the need for an increase in the size of the unit.

In the switching unit and switching gear according to this embodiment, the insulating resin has fins formed on the insulating resin outer surface in the circumferential direction and the distance of the vacuum valve and the periphery of the aerial-grounding disconnection part from the resin radiating fin bottoms is circumferentially almost constant and in consideration of temperature distribution attributable to low thermal conductivity peculiar to resin radiating fins, the radiation efficiency is improved to prevent the unit size from being larger than necessary, without sacrificing cooling performance. If these fins are not used, the unit must be larger for heat radiation; rather, the presence of these fins improves heat radiation performance and contributes to making the entire unit more compact. With the above structure, cooling performance can be improved in a low-resistance circuit switch which can turn on and off high voltage/high current, breaks the circuit and perform grounding.

In this embodiment, the outer surface of the insulating resin 2 has a flat part 2*p* and the tip of the insulating resin 2 is located inside the flat part 2*p* surface, so the fin tips are not damaged even when the switching unit after being cast with the insulating resin 2 is laid down during assembling work, etc.

In addition, in this embodiment, inner curvature 1*b*-out of the fin with the largest fin radial height is larger than inner curvature 1*b*-in of the fins other than the fin with the largest height, which permits stress concentration on the fin with the largest fin radial height and also alleviates concentration of electric fields. For this embodiment, it has been explained that only the fin with the largest fin radial height has a large inner curvature; however, it is also effective to make fins with larger radial height have larger curvatures and fins with smaller height have smaller curvatures, according to the fin radial height. In addition, it becomes possible to ensure strength and insulation performance of the edges of the outer surface of the resin layer covering the conductors and container.

Also in this embodiment, the resin radiating fins 1 are oriented in four different directions at regular intervals of 90 degrees as shown in FIG. 2, which means that the tips of the resin radiating fins 1 form two pairs of planes: a pair of planes facing each other with the aerial grounding disconnection part 27 or the vacuum cylinder 26 between them and a pair of planes facing each other with the aerial grounding disconnection part 27 and the vacuum valve 26 between them. For this reason, when releasing the product from the mold after casting, the mold can be pulled out in the direction in which the resin radiating fins 1 are oriented (without being caught by the fins) and the manufacturing process is easier.

Second Embodiment

The second embodiment will be described referring to FIGS. 3 and 4. Descriptions of the same elements as in the first embodiment will be omitted.

Figure 3:
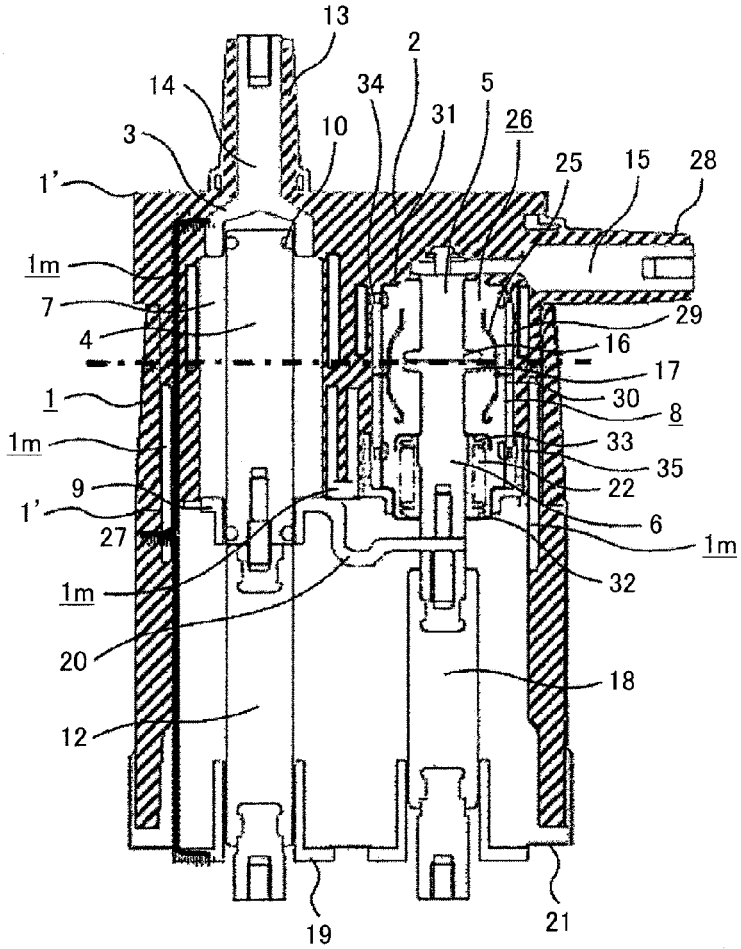
FIG. 3 is a side sectional view of a switching unit according to a second embodiment.
Figure 4:
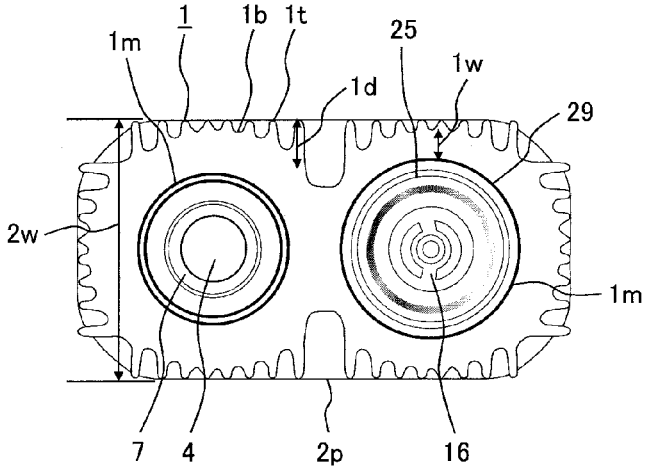
FIG. 4 is a sectional view of the switching unit according to the second embodiment, taken along the line A-A'.

As shown in FIGS. 3 and 4, in this embodiment, metal radiating plates 1*m* located inside the insulating resin 2 function as both an insulating shield and a heat radiating member simultaneously. Also the metal radiating plates 1*m* are connected and fixed to the bus bushing 13, cable bushing 28, and middle fixed electrode 9 which are heat accumulation spots, and the heat is radiated to the resin layer, in which the resin radiating fin height is large in (largest height 1') in a resin layer high-temperature area and is smaller in remoter areas than the area. The height of the resin radiating fins 1 is the largest around the radiating plate 1*m* nearest to the insulating resin 2 surface among the radiating plates 1*m* and the height is smaller in remoter areas from around the radiating plate 1*m* nearest to the insulating resin 2 surface. The radiating plates 1*m* are located between the vacuum valve 26 and the grounding disconnection part 27, around the vacuum valve 26 and around the grounding disconnection part 27, and the radiating plate 1*m* near the actuator is located near the insulating resin 2 surface. Since the height of the fins in the vicinity of the radiating plate near the outer periphery is increased to improve heat radiation performance, cooling can be performed more appropriately for a temperature condition which occurs with the power on.

In addition, the tips of the metal radiating plates 1*m* have the required minimum curvature (roundness) for insulation performance so that the plates can function as insulating shields.

In this embodiment, due to the presence of the radiating plates 1*m*, heat from a heat accumulation spot is moved to an area where heat should be radiated. The height of the resin radiating fins 1 is the largest around the radiating plate 1*m* nearest to the insulating resin 2 surface among the radiating plates 1*m* and in axially remoter areas from around the radiating plate 1*m* nearest to the insulating resin 2 surface, the height is smaller, so that the moved heat can be efficiently radiated. More preferably, when the radiating plates 1*m* are formed (connected) on the conductors inside the insulating resin 2 and the edges of the vacuum valve 26 in a way to surround the conductors and the area around the vacuum valve 26, heat from the conductors and the vacuum valve 26 is transferred to the radiating plates 1*m*, where heat is accumulated, so in an area where the surface temperature of the insulating resin 2 outer surface near the heat-accumulated radiating plate 1*m* is highest, the height of the resin radiating fins 1 in the longitudinal direction is largest and in the other areas, the height is smaller.

It is obvious that even when the metal radiating plates 1*m* are combined with the resin radiating fins 1 as in this embodiment, the same various advantageous effects as described in connection with the first embodiment can be brought about. What is common to both the embodiments is that the height of the resin radiating fins is not uniform in the longitudinal and circumferential directions but the height gradually changes and in order to achieve further advantageous effects the height of the resin radiating fins in a heat accumulation spot is made the largest to enhance cooling performance.

Third Embodiment

Figure 6:
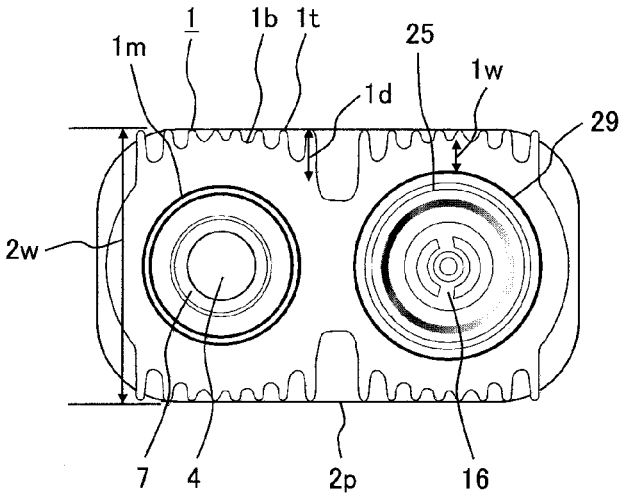
FIG. 6 is a sectional view of the switching unit according to the third embodiment, taken along the line A-A'.
Figure 7:
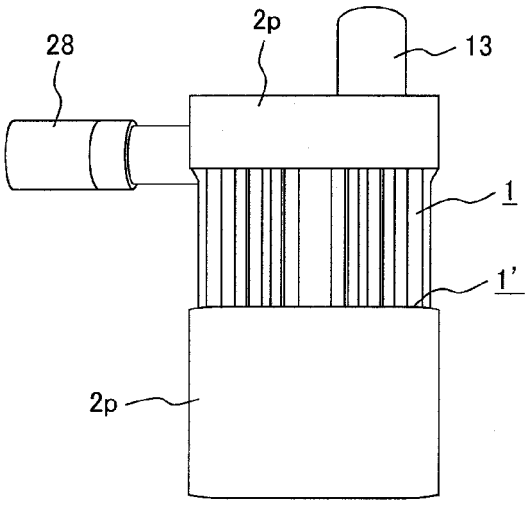
FIG. 7 is an external view of the switching unit according to the third embodiment.

The third embodiment will be described referring to FIGS. 5 to 7. In this embodiment as well, descriptions of the same elements as in the above embodiments will be omitted.

Figure 5:
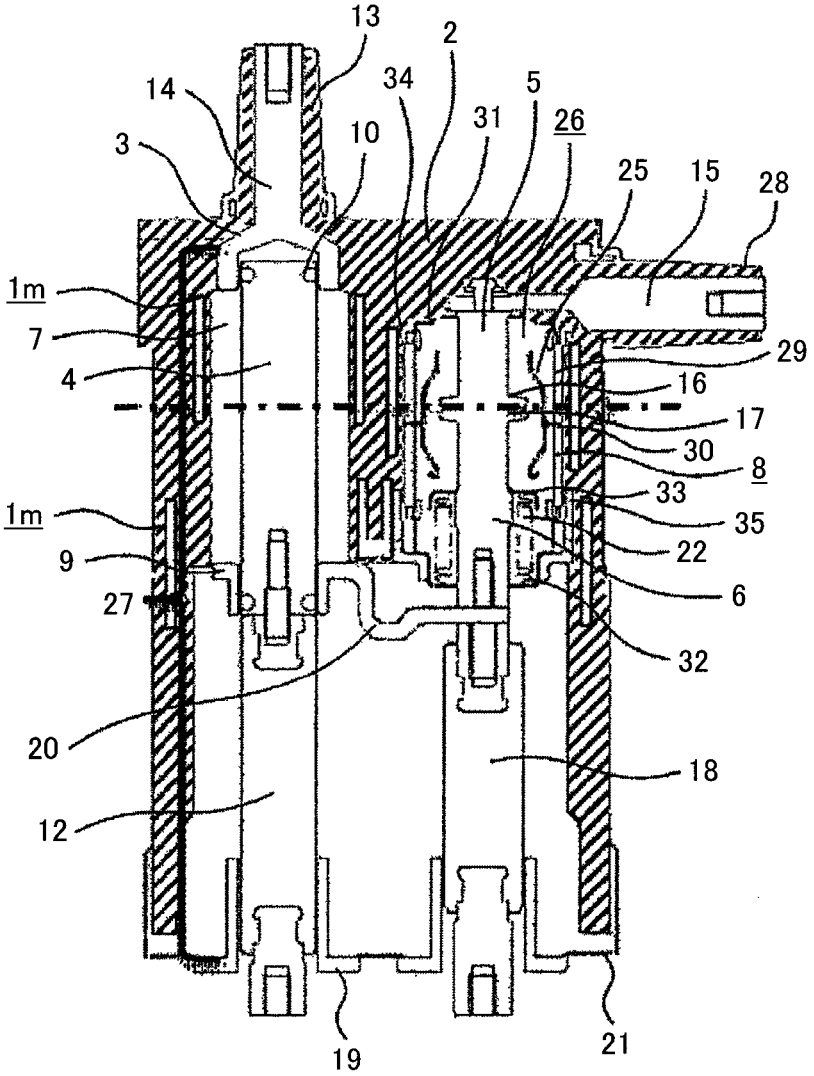
FIG. 5 is a side sectional view of a switching unit according to a third embodiment.

In the first and second embodiments, the tips of the resin radiating fins 1 form two pairs of planes: a pair of planes facing each other with the aerial grounding disconnection part 27 or the vacuum valve 26 between them and a pair of planes facing each other with the aerial grounding disconnection part 27 and the vacuum valve 26 between them; on the other hand, in this embodiment, as shown in the sectional view of FIG. 5, when the whole outer surface of the integrally cast switch is formed with cooling fins thereon, in order to minimize the number of casting mold parts, resin radiating fins are not provided on both the lateral sides, and the resin distance 1W between the bottoms 1*b* of the resin radiating fins on the front and rear sides and the periphery of the vacuum container 8 is kept constant.

As in this embodiment, it is possible that metal radiating plates 1*m* are provided and resin radiating fins 1 are located only on a pair of planes facing each other. Another approach that no metal radiating plate 1*m* is provided and resin radiating fins 1 are located only on a pair of planes facing each other is not excluded. To what extent the cooling performance should be improved depends on the amount of supplied current, the temperature of the installation environment and so on. It is obvious that various modifications as described here are possible.

Fourth Embodiment

Figure 8:
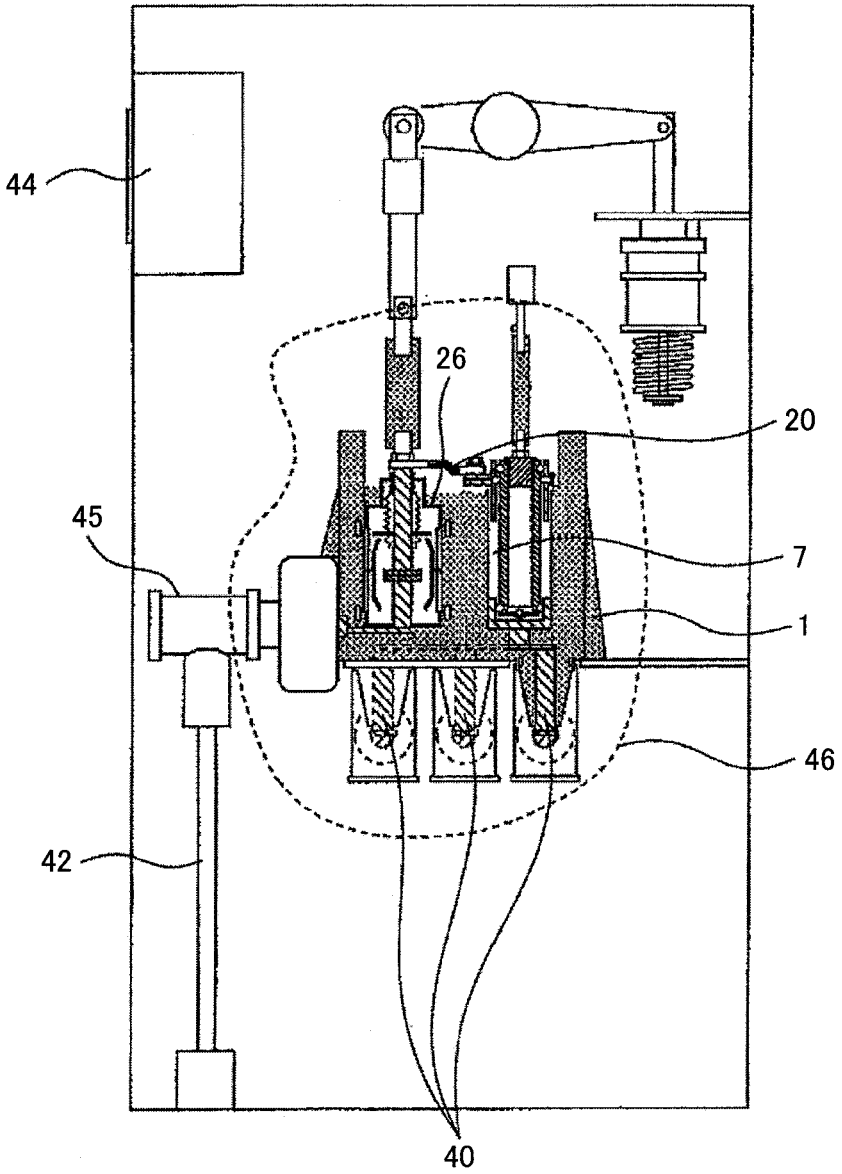
FIG. 8 is a view showing switching gear according to a fourth embodiment.

The fourth embodiment will be described referring to FIG. 8. In this embodiment as well, descriptions of the same elements as in the above embodiments will be omitted.

The switching gear according to this embodiment is roughly comprised of a bus 40 connected to the power system to receive power, a switching unit 46 being connected to the bus 40 and including a switch, a cable 42 for distributing power from the switching unit 46 to a load, a cable head 45 for connecting the switching unit 46 according to the first embodiment and the cable 42, an actuator 43 for operating the switch in the switching unit 46, and a control device chamber 44 housing a protective relay, etc. to protect a device at the time of detection of overcurrent, stroke of lightning, etc.

The switching unit 46 is not limited to the abovementioned one according to the first embodiment and it may be any one of other various switching units including the ones according to the abovementioned embodiments. At least the abovementioned advantageous effects are not impaired by applying any of such switching units to the switching gear.

In the switching gear according to this embodiment, the switching unit 46 has resin radiating fins for heat radiation, the height of which gradually changes not only in the longitudinal direction but also in the circumferential direction, so the cooling performance can be improved in the switching gear as a whole because a main heat generating spot in the switching gear (board) is the switching unit.

Another noteworthy point is that the whole switching gear can be compact because the switching unit as a main component of the switching gear can be compact.

REFERENCE SIGNS LIST

1 . . . resin radiating fin
1' . . . largest height of resin radiating fin
1*b* . . . bottom of resin radiating fin
1*b*-in . . . inner curvature of resin radiating fin
1*b*-out . . . inner curvature of resin radiating fin with largest fin radial height
1*d* . . . height of resin radiating fin
1*m* . . . radiating plate
1*t* . . . tip of resin radiating fin
1*t*-in . . . curvature of resin radiating fin tip
1*t*-out . . . tip curvature of resin radiating fin with largest fin height
1*w* . . . resin distance between resin radiating fin bottom and vacuum container periphery
2 . . . insulating resin
2*p* . . . (resin surface) flat part
2*w* . . . width between symmetric flat parts of resin surface
3 . . . bushing fixed electrode
4 . . . grounding disconnection part movable conductor
5 . . . fixed side conductor
6 . . . movable side conductor
7 . . . air area
8 . . . vacuum container
9 . . . middle fixed electrode
10 . . . spring contact
11, 28 . . . cable bushing
12, 18 . . . actuating rod
13 . . . bus bushing
14 . . . bus bushing center conductor
15 . . . cable bushing center conductor
16 . . . fixed side electrode
17 . . . movable side electrode
19 . . . grounding side fixed electrode (guide)
20 . . . flexible conductor
21 . . . metal case
22 . . . bellows
26 . . . vacuum valve
27 . . . grounding disconnection part
29 . . . fixed side ceramics insulating cylinder
30 . . . movable side ceramics insulating cylinder
31 . . . fixed side end plate
32 . . . movable side end plate
33 . . . bellows shield
34 . . . fixed side field alleviating shield
35 . . . movable side field alleviating shield
40 . . . bus
42 . . . cable
43 . . . actuator
44 . . . control device chamber
45 . . . cable head
46 . . . switching unit

The invention claimed is:

1. A switching unit comprising:
a switch including:
a fixed electrode;
a movable electrode facing the fixed electrode and moving in an axial direction to contact or leave the fixed electrode;
a bus side conductor connected to one of the electrodes and connected to a bus; and
a load side conductor connected to the other electrode and connected to a load; and
insulating resin located in a way to cover a periphery of the switch, wherein
the insulating resin has fins formed in a circumferential direction on an outer surface of the insulating resin and distance between the periphery of the switch and bottoms of the fins is almost constant in the circumferential direction.

2. The switching unit according to claim 1, wherein the outer surface of the resin has a flat part and a tip of the resin is formed so as to be located inside a surface of the flat part.

3. The switching unit according to claim 1, wherein an inner curvature of a fin with largest radial fin height among the fins is larger than inner curvatures of fins other than the fin with the largest radial fin height.

4. The switching unit according to claim 1,
the switch being a vacuum switch with a vacuum container housing the fixed electrode and the movable electrode;
the unit further comprising:
a switch with a grounding function including
one or more other fixed electrodes;
one or more other movable electrodes facing the fixed electrode(s) and moving in the axial direction to contact or leave the other fixed electrode(s);
another bus side conductor connected to any of the other electrodes and connected to the bus; and
another load side conductor connected to any of the other electrodes and connected to the load, wherein
the switch and the vacuum switch are electrically connected through a conductor;
the insulating resin is located in a way to cover peripheries of the switch and the vacuum switch; and
fins are formed in the circumferential direction on the outer surface of the insulating resin and the inner curvature of a fin with largest radial fin height among the fins is larger than the inner curvatures of the fins other than the fin with the largest radial fin height.

5. The switching unit according to claim 4, wherein the switch and the vacuum switch are arranged side by side; and tips of the fins form a pair of planes facing each other with the switch or the vacuum switch between the planes.

6. The switching unit according to claim 5, wherein the tips of the fins form another pair of planes being perpendicular to the pair of planes and facing each other with the switch and the vacuum switch between the planes.

7. The switching unit according to claim 4, wherein a radiating plate, being connected to any of the conductors and covering a periphery of the switch or the vacuum switch in the axial direction, is located inside the insulating resin; and the fins are formed in a way to surround a periphery of the radiating plate.

8. The switching unit according to claim 4, wherein height of the fins is largest in an area around a radiating plate nearest to a surface of the insulating resin among the radiating plates and is smaller in remoter areas from the area around the radiating plate nearest to the surface of the insulating resin.

9. The switching unit according to claim 7, wherein the radiating plate has a round tip.

10. Switching gear comprising:

the switching unit according to claim 1;

a bus and a cable which are connected to the switching unit;

an actuator which generates an operating force to drive any of the movable electrodes;

a control device chamber housing a protective relay; and a case housing the switching unit, the bus, the cable, the actuator, and the control device chamber.

11. The switching unit according to claim 2, wherein an inner curvature of a fin with largest radial fin height among the fins is larger than inner curvatures of fins other than the fin with the largest radial fin height.

12. The switching unit according to claim 2, the switch being a vacuum switch with a vacuum container housing the fixed electrode and the movable electrode;

the unit further comprising:

a switch with a grounding function including one or more other fixed electrodes;

one or more other movable electrodes facing the fixed electrode(s) and moving in the axial direction to contact or leave the other fixed electrode(s);

another bus side conductor connected to any of the other electrodes and connected to the bus; and another load side conductor connected to any of the other electrodes and connected to the load, wherein the switch and the vacuum switch are electrically connected through a conductor;

the insulating resin is located in a way to cover peripheries of the switch and the vacuum switch; and fins are formed in the circumferential direction on the outer surface of the insulating resin and the inner curvature of a fin with largest radial fin height among the fins is larger than the inner curvatures of the fins other than the fin with the largest radial fin height.

13. The switching unit according to claim 3, the switch being a vacuum switch with a vacuum container housing the fixed electrode and the movable electrode;

the unit further comprising:

a switch with a grounding function including one or more other fixed electrodes;

one or more other movable electrodes facing the fixed electrode(s) and moving in the axial direction to contact or leave the other fixed electrode(s);

another bus side conductor connected to any of the other electrodes and connected to the bus; and another load side conductor connected to any of the other electrodes and connected to the load, wherein the switch and the vacuum switch are electrically connected through a conductor;

the insulating resin is located in a way to cover peripheries of the switch and the vacuum switch; and fins are formed in the circumferential direction on the outer surface of the insulating resin and the inner curvature of a fin with largest radial fin height among the fins is larger than the inner curvatures of the fins other than the fin with the largest radial fin height.

14. The switching unit according to claim 11, the switch being a vacuum switch with a vacuum container housing the fixed electrode and the movable electrode;

the unit further comprising:

a switch with a grounding function including one or more other fixed electrodes;

one or more other movable electrodes facing the fixed electrode(s) and moving in the axial direction to contact or leave the other fixed electrode(s);

another bus side conductor connected to any of the other electrodes and connected to the bus; and another load side conductor connected to any of the other electrodes and connected to the load, wherein the switch and the vacuum switch are electrically connected through a conductor;

the insulating resin is located in a way to cover peripheries of the switch and the vacuum switch; and fins are formed in the circumferential direction on the outer surface of the insulating resin and the inner curvature of a fin with largest radial fin height among the fins is larger than the inner curvatures of the fins other than the fin with the largest radial fin height.

15. The switching unit according to claim 12, wherein the switch and the vacuum switch are arranged side by side; and tips of the fins form a pair of planes facing each other with the switch or the vacuum switch between the planes.

16. The switching unit according to claim 15, wherein the tips of the fins form another pair of planes being perpendicular to the pair of planes and facing each other with the switch and the vacuum switch between the planes.

17. The switching unit according to claim 12, wherein a radiating plate, being connected to any of the conductors and covering a periphery of the switch or the vacuum switch in the axial direction, is located inside the insulating resin; and the fins are formed in a way to surround a periphery of the radiating plate.

18. The switching unit according to claim 12, wherein height of the fins is largest in an area around a radiating plate nearest to a surface of the insulating resin among the radiating plates and is smaller in remoter areas from the area around the radiating plate nearest to the surface of the insulating resin.

19. The switching unit according to claim 17, wherein the radiating plate has a round tip.

20. Switching gear comprising:

the switching unit according to claim 2;

a bus and a cable which are connected to the switching unit;

an actuator which generates an operating force to drive any of the movable electrodes;

a control device chamber housing a protective relay; and a case housing the switching unit, the bus, the cable, the actuator, and the control device chamber.

21. The switching unit according to claim 1, wherein the distance between the periphery of the switch and the bottoms of the fins is a distance between an outer edge of an insulating cylinder of the switch and the bottoms of the fins.

22. The switching unit according to claim 1, wherein the fins are made of the insulating resin.

* * * * *